US005329802A

United States Patent [19]

Nunez

[11] Patent Number: 5,329,802

[45] Date of Patent: Jul. 19, 1994

[54] AUTOMATIC SLIDE HAMMER ATTACHMENT

[76] Inventor: Delio A. Nunez, 25-53 99th St., E. Elmhurst, N.Y. 11369

[21] Appl. No.: 35,706

[22] Filed: Mar. 23, 1993

[51] Int. Cl.[5] ..... B21D 1/12

[52] U.S. Cl. ..... 72/457; 72/705

[58] Field of Search ..... 72/457, 705

[56] References Cited

U.S. PATENT DOCUMENTS 4,072,042 2/1978 Servin et al. ..... 72/705

4,653,167 3/1987 Mullins ..... 72/705

*Primary Examiner*—Lowell A. Larson

[57] ABSTRACT

Attachment for a power source such as a rotary drill equipped with a forward (clockwise) and reverse (counterclockwise) feature. Such attachment can be fixedly secured to a power source. The turning power of the chosen power source drives the enlongated cylindrical body with the attached self-drilling sheet metal screw causing it to automatically engage onto or disengage itself from a work piece. A strike washer and a stop member placed on the opposite ends of each other and a weighted impact member which is manually slided along the enlongated cylindrical body and driven into contact with either mentioned members. The force of the impact will either pull outwardly the damaged area of a sheet metal work piece to which the tool is attached or push it inwards depending upon the direction of the applied impact in order to return it to its original contour.

2 Claims, 5 Drawing Sheets

AUTOMATIC SLIDE HAMMER ATTACHMENT

FIELD OF THE INVENTION

The present invention relates in general to power tool attachments capable of attaching to a forward (clockwise) and reverse (counterclockwise) rotary power source such as a hand drill. More particularly, the present invention relates to tools used for repairing bodies of vehicles such as automobiles, trucks, airplanes, boats, and the like and primarily relates to the practice of removing dents from damaged surfaces so as to return the vehicle's body to its original contour.

DESCRIPTION OF RELATED ART

For many years, tools have been invented for the purposes of making it easier and faster to repair dented metals. U.S. Pat. Nos. 3,030,837 and 3,570,289 are slide hammers with a screw end which may be the most commonly used in autobody repair shops, but they need more than one tool to complete the job, such as a hand drill or other puncture devices to make a hole, and a slide hammer with a screw end which is used to be engaged within the hole of a metal work piece, and also to create an impact to deform the metal. U.S. Pat. Nos. 3,584,836 and 4,753,104 both utilize suction cups, but these tools cannot work effectively with creases, especially accordion creases which would allow the air to escape and thereby, its usefulness is limited.

SUMMARY OF THE INVENTION

The present invention provides an apparatus which is attachable to a rotary power source such as a portable hand drill. A new, improved, and economical yet effective metal repair tool that can readily be transported from place to place by the user, and can automatically be engage onto or disengage itself from a metal work piece has been discovered.

Unlike previous referenced tools, this present invention when attached onto a preferred air powered hand drill equipped with a forward (clockwise) and reverse (counterclockwise) rotary feature, can easily and automatically engage onto or disengage itself from any type of metal. It is most commonly used on sheet metals on the bodies of vehicles such as automobiles, trucks, airplanes, boats, and the like, without the need of having to use two separate tools, such as a hand drill to make a hole and a body working tool, better known as a slide hammer to be manually engaged onto or disengaged from a metal work piece and also used to create an impact to deform the damaged metal.

The present invention is pushed inward against the desired work piece and set on forward (clockwise) and is activated. The drill bit tip of the attached self-drilling sheet metal screw will then penetrate and will make a hole and the threaded portion will then follow and engage itself onto the work piece automatically. The provided impact member is then manually operated to move towards the direction of the hand drill or to the rearward end of the tool to create an impact onto a stop member to move the entire assembly and the engaged work piece outwardly in the same direction as the impact to restore it to its original form.

If the work piece was pulled outwardly exceeding the original contour, the mentioned procedure is reversed to create an impact onto a strike washer located near the self-drilling sheet metal screw or on the forward end of the tool in order to return the overpulled work piece to its original form.

After you have reached the original form of the work piece, the drill is set on reverse (counterclockwise) and is activated. The tool will automatically disengage itself from the work piece.

The present invention will become more apparent upon consideration of the following description, and the functions of the related elements will also become clearer taken in connection with the accompanying drawings.

BRIEF DESCRIPTION OF THE DRAWINGS

These and other advantages can be better appreciated by studying the following detailed description of the presently preferred exemplary embodiment together with the drawings in which.

DETAILED DESCRIPTION

Figure 3:
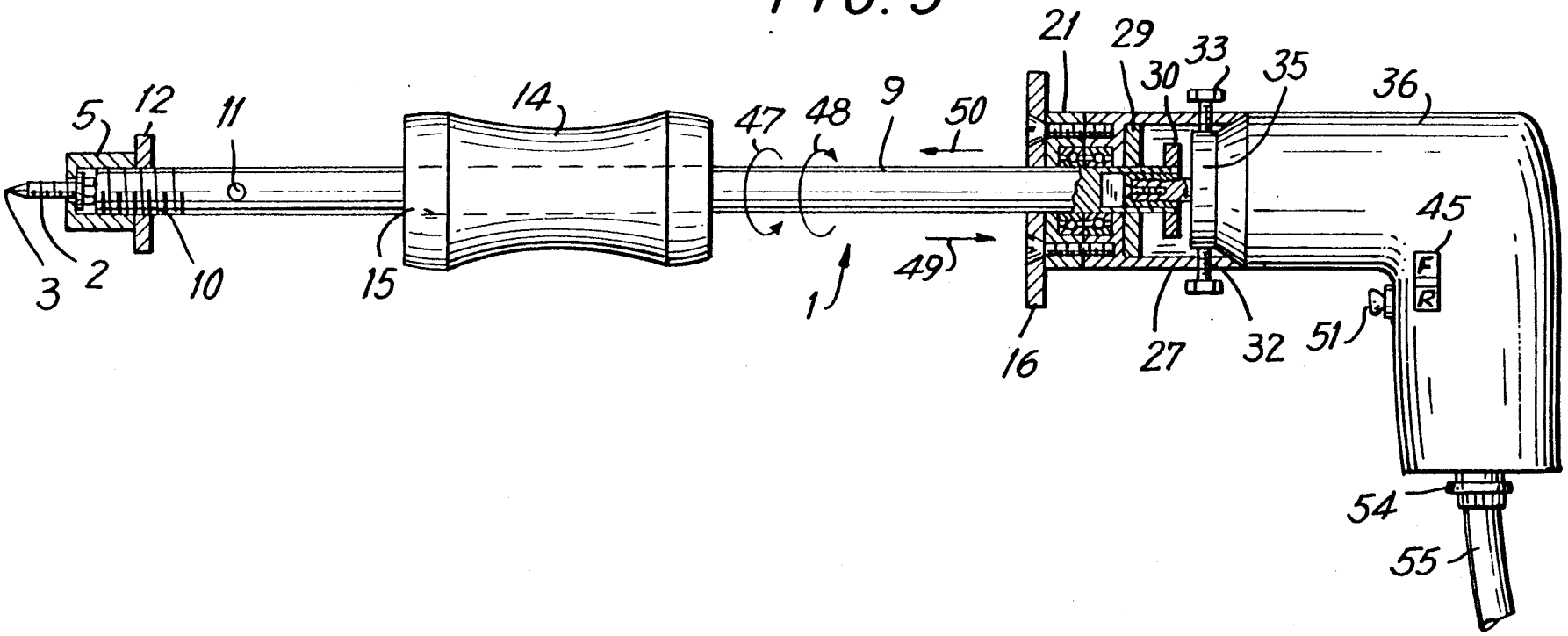
FIG. 3 is a side perspective view of the embodiment of the present invention.

Refer now to FIG. 3 which is an overall drawing of a preferred embodiment of the present invention. It will be noted that the present invention itself, generally indicated by the Number 1 includes an enlongated cylindrical body 9, a 1st closure member 5, and a permanently secured stop member 30.

Figure 1:
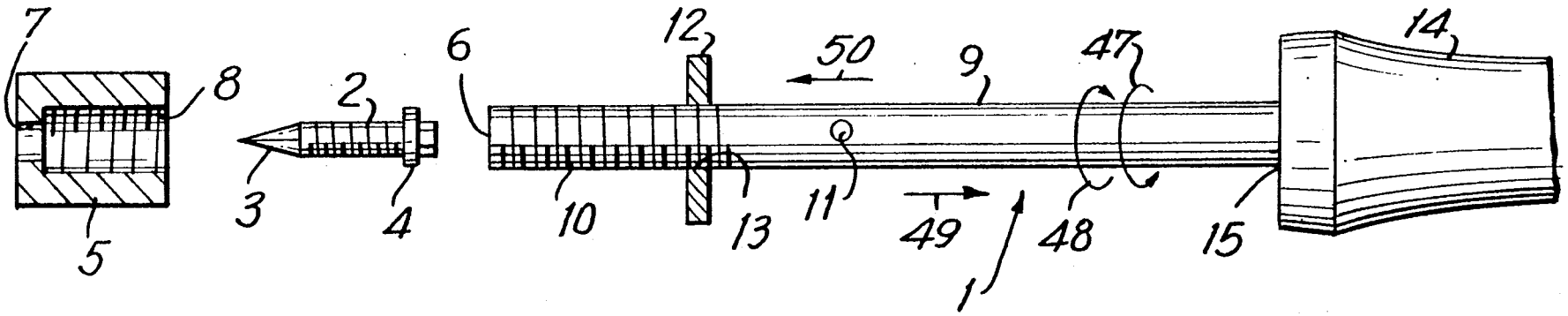
FIG. 1 is showing the actual tip and screw attachments and also shows the inside detail of the complete forward end of the tool.

Considering next, the forward end of the present invention 1 in greater detail and referring particularly to FIG. 1. It will be seen that this forward end of the enlongated cylindrical body 9 has a flat base 6 followed by a threaded portion 10. Threadingly secured onto the mentioned threaded portion 10 is a 1st closure member 5 which, in turn, has an internally threaded undercut 8 and an aperture 7 for purposes which will now be described in greater detail.

Figure 4:
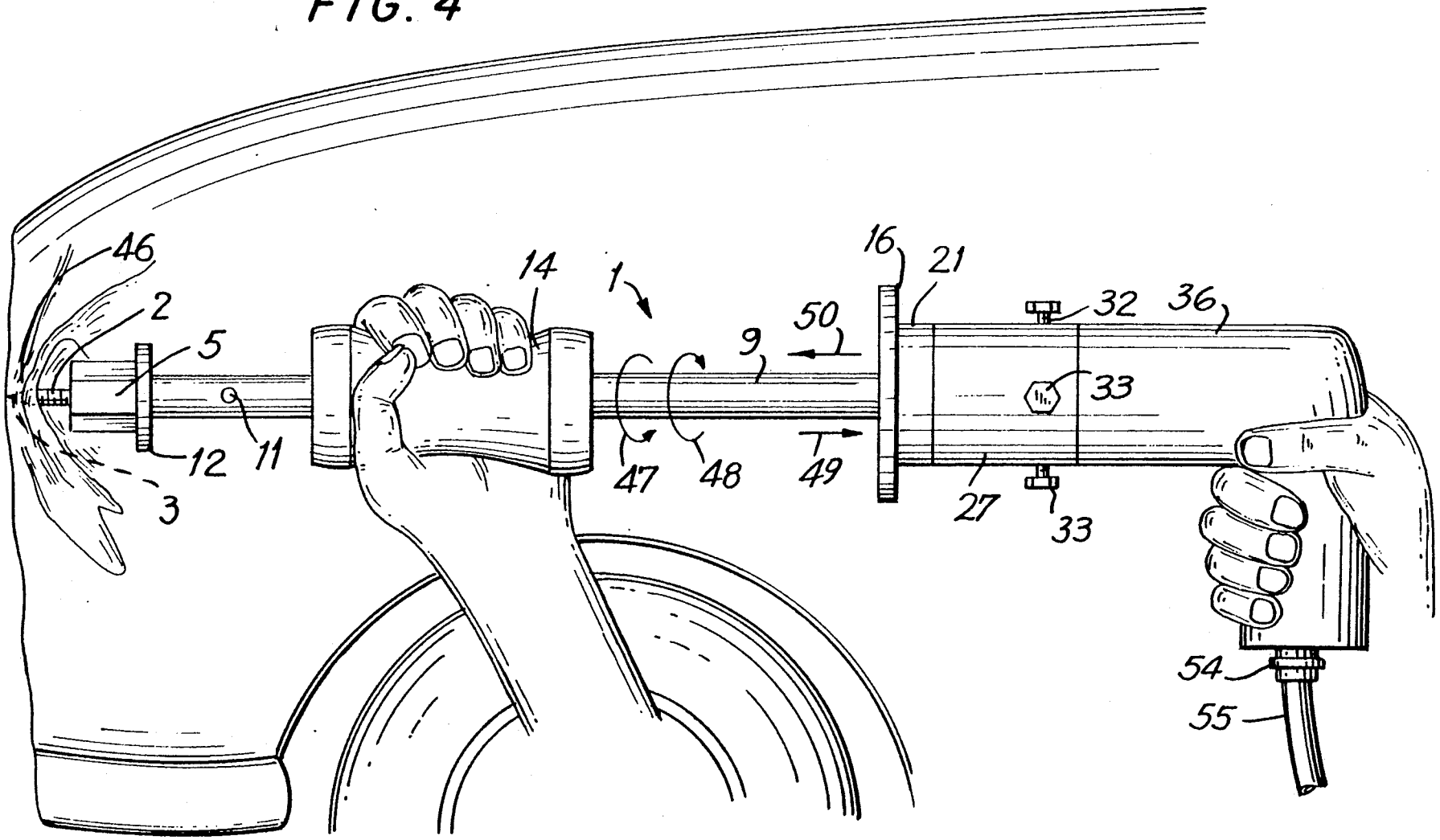
FIG. 4 is a perspective view of the tool shown in conjunction with a conventional metal fender of an automobile.

Received within the aperture 7 of the 1st closure member 5 is the enlongated threaded body of a self-drilling sheet metal screw 2 for attachment onto a metal work piece 46 (shown in FIG. 4). The enlongated threaded body is pushed through the mentioned aperture 7 until the head 4 (preferably a hexagonal head) of the self-drilling sheet metal screw 2 comes into contact with the inner base of the mentioned aperture 7. The head 4 of the self-drilling sheet metal screw 2 is larger than the aperture 7, thereby preventing the mentioned head 4 from passing through the mentioned aperture 7, and creating a shoulder which holds the self-drilling sheet metal screw 2 firmly in place when the 1st closure member 5 is secured onto the threaded portion 10 of the enlongated body 9.

The enlongated cylindrical body 9 as shown in FIG. 1, has a through aperture 11 to insert a metal rod or a screw driver in between the mentioned aperture 11 to prevent the enlongated cylindrical body 9 from moving when tightening the st closure member 5 onto the threaded portion 10 of the enlongated cylindrical body 9. The 1st closure member 5 could be of many shapes, but for this invention you will see a preferred hexagonal shape.

The strike washer 12 as shown in FIG. 1 includes interior threads 13 which are adapted to be engaged and in frictional contact with the threaded portion 10 of the enlongated cylindrical body 9 for purposes which will be described in greater detail as you read on.

The chosen power source as shown in FIG. 3, preferably a standard hand held air drill 36 also used as a gripping member, must be equipped with a forward (clockwise) and reverse (counterclockwise) rotary feature which is worked by a two-way switch 45.

The impact member 14 as shown in FIG. 3 has a precisely cut through central aperture 15 (unlike other impact members), snugged, but slidably mounted on the exterior of the enlongated cylindrical body 9 to help guide, balance, and hold steady the mentioned body 9 which in turn holds steady the exact position of the drill bit tip 3 of the self-drilling sheet metal screw 2 when placed against the work piece 46 as shown in FIG. 4. The impact member 14 is manually operated, and is of sufficient weight to create an impact onto a strike washer 12 or a stop member 16 located on the opposite ends of each other.

Figure 2:
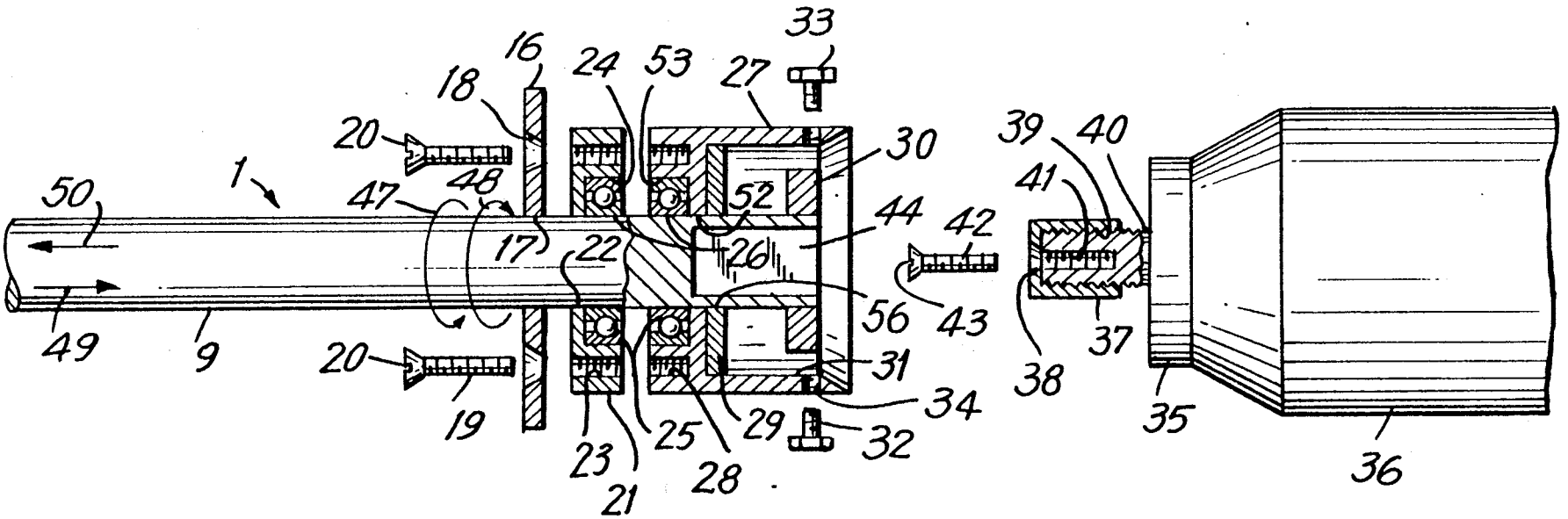
FIG. 2 shows the connections in great detail of the slide hammer attachment and the chosen power source.

The stop member 16 as shown in FIG. 2 is bigger in diameter than the 2nd closure member 21 and has four small apertures 18 for purposes which will be described in greater detail as you read on, and also has a through central aperture 17 to allow the enlongated cylindrical body 9 to move freely within. The stop member 16 is used to receive an impact and to prevent your hand and fingers from getting caught in between the mentioned stop member 16 and the impact member 14 when an impact is created.

The stop member 16 is secured onto the 2nd closure member 21 as shown in FIG. 2. By means of inserting four enlongated threaded screws 19 with a flat head 20 disposed between and in frictional contact with the four apertures 18 of the mentioned stop member 16; with the threaded body of the mentioned screw 19 projecting through the mentioned apertures 18, and also projecting through and in frictional contact with the four threaded apertures 23 of the 2nd closure member 21 and in frictional contact with the four internally threaded cut-outs 28 of the stop and closure member 27. Let it be noted: The stop member 16, the 2nd closure member 21, and the stop and closure member 27 are all secured together by the same enlongated threaded screw 19.

Continuing on, the 2nd closure member 21 as shown in FIG. 2 also has a central aperture 22 in through the center to allow the enlongated cylindrical body 9 to move freely within. On the rearward end of the 2nd closure member 21 you will see a cylindrical cutout 24 where one bearing 25 is placed.

The stop and closure member 27 as shown in FIG. 2 has a cylindrical cutout 53 for one bearing 25 located on the forward end of the mentioned stop and closure member 27 and an aperture 52, the same as the above mentioned aperture 17 and aperture 22, in the center to allow the enlongated cylindrical body 9 to move freely within.

The bearings 25 as shown in FIG. 2 have a through central aperture 26 with the mentioned apertures sitting closer to the enlongated cylindrical body 9 than that of the stop member 16, the 2nd closure member 21, and the stop and closure member central apertures. The bearings 25 are used to help guide and balance the enlongated cylindrical body 9, and also used to prevent frictional contact between the enlongated cylindrical body 9, stop member 16, 2nd closure member 21, and stop and closure member 27 when the enlongated cylindrical body 9 moves in the direction of arrows 47, 48, 49, and 50.

A permanently secured stop member 29 is used inside the mentioned stop and closure member 27 as shown in FIG. 2 to receive an impact from the stop member 30 when an impact is created. The mentioned stop member 29 has an aperture 56 to allow the enlongated cylindrical body 9 to move freely within. The stop member 30 is permanently secured to the rearward end of the enlongated cylindrical body 9 or in the opposite end of the threaded portion 10, so as to prevent the mentioned body 9 from separating apart from the 3rd closure member 37 located on the hand held air drill 36 when an impact is created.

As shown in FIG. 2, the remaining portion inside of the stop and closure member 27 is a hollow housing 31 slightly bigger in diameter to overlap the hand held air drill's housing 35, and also used to enclose the 3rd closure member 37, the enlongated threaded screw 42, stop member 29, stop member 30, and the standard threaded body 40 of the hand held air drill 36.

The hollow housing 31 and housing 35 are secured together by inserting four threaded metal bolts 32 with a hexagonal head 33 as shown in FIG. 2 with the threaded body of the mentioned threaded bolts 32 projecting through and in frictional contact with the threaded apertures 34 surrounding the hollow housing 31 of the stop and closure member 27, and also in frictional contact with the outer walls of housing 35. This will secure both mentioned housings together as shown in FIG. 2 when the mentioned threaded metal bolts 32 are tightened.

The standard drill chuck of the hand held air drill 36 must be removed and the 3rd closure member 37 will be put in its place as shown in FIG. 2. The mentioned closure member 37 has a central aperture 38 in its base for purposes which will be described in greater detail as you read on, and also contains an internally threaded undercut 39 to be threadingly secured onto the standard threaded body 40 of the mentioned hand held air drill 36.

The 3rd closure member 37 as shown in FIG. 2 is kept from disengaging itself from the standard threaded body 40 by inserting the same provided standard enlongated threaded screw 42 that was previously used to secure the drill chuck onto the hand held air drill 36. The flat head 43 of the mentioned screw 42 is disposed between and in frictional contact with the aperture 38 of the 3rd closure member 37, with the threaded body of the mentioned screw 42 projecting through the aperture 38, and in frictional contact with the internally threaded cutout 41 of the standard threaded body 40 of the hand held air drill 36.

The 3rd closure member 37 fits slightly loose into a slightly larger duplicate cutout 44 which is located at the opposite end of the threaded portion 10 of the enlongated cylindrical body 9. The 3rd closure member 37 could be of many shapes, but for this present invention you will see a preferred square shape. The 3rd closure member 37 moves freely in and out of the duplicate cutout 44 in the direction of the arrows 49 and 50. This procedure will allow the enclosed stop member 29 and the stop member 30 to separate from one another to prevent frictional contact between them, and also to prevent the enlongated cylindrical body 9 and the 3rd closure member 37 from becoming permanently secured to one another. Let it be noted: It is recommended that stop member 29 and stop member 30 should not separate more than five millimeters so as to reduce the overall length of the tool. The mentioned closure member 37 is also used to turn the enlongated cylindrical body 9 in either direction of the arrows 47 and 48 provided by the turning power of the hand held air drill 36.

Continuing on, preventing the 3rd closure member 37 (shown in FIG. 2) and the enlongated cylindrical body 9 from becoming secured onto one another will prevent the enlongated cylindrical body 9 from pulling the 3rd closure member 37, which is now attached to the standard threaded body 40 of the hand held air drill 36, which can cause damage to the mentioned hand held air drill's 36 fragile inner parts when an impact is created. Air hose 55 (as shown in FIG. 3) is secured onto the hand held air drill's 36 air inlet 54 to provide air power used to rotate the mentioned drill 36 from a commonly used air compressor.

Figure 5:
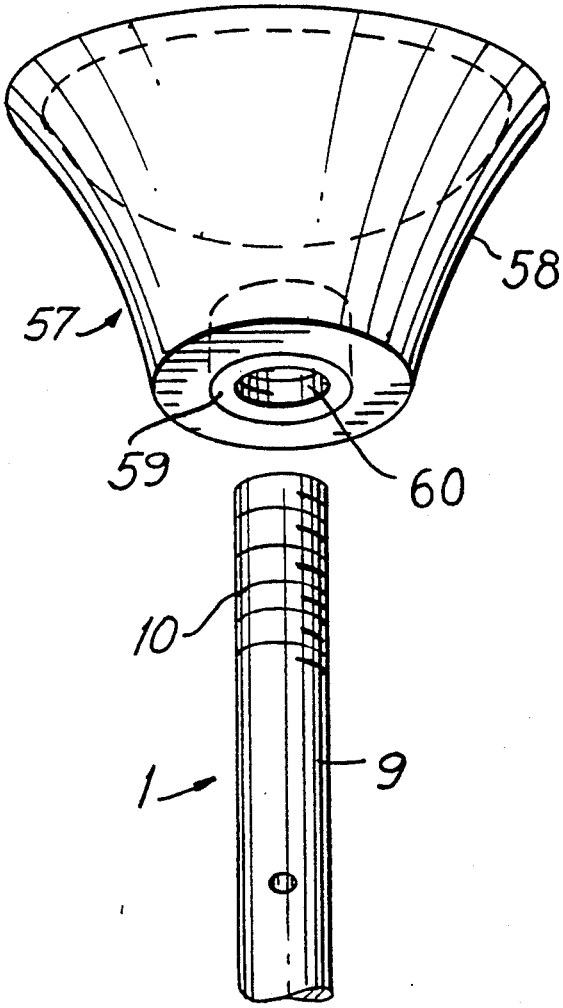
FIG. 5 is a perspective view of a suction cup.

FIG. 5 illustrates a possible modification of the means for attaching the tool to a work piece. The suction cup 57 has particular utility where the user wishes to avoid drilling a hole in a work piece. The suction cup 58 has a permanently secured threaded nut 59 with a threaded undercut 60 placed on the rearward end of the suction cup 58, and can be threadingly secured onto the threaded portion 10 of the enlongated body 9 to be used when applicable.

Figure 6:
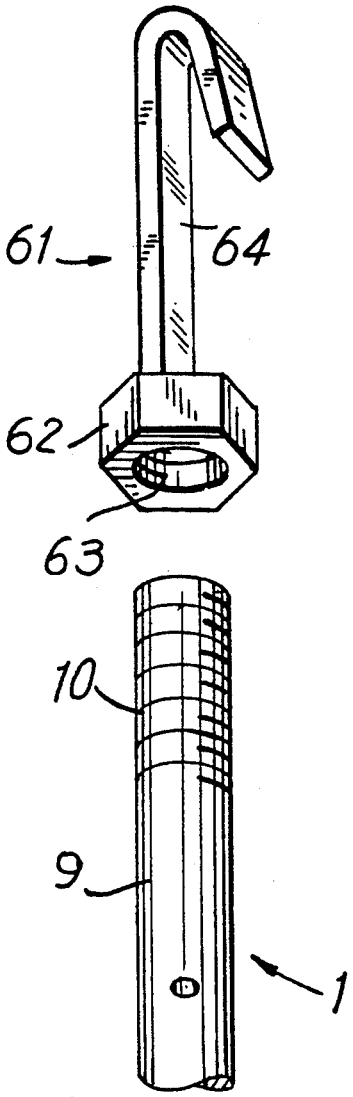
FIG. 6 is a perspective view of a hook-shaped gripper, which like the suction cup can be secured to the forward end of the tool.

FIG. 6 depicts another possible modification for attaching the tool to a work piece which is a narrow hook-shaped gripper 61 which has a permanently secured threaded nut 62 with a threaded undercut 63 placed on the rearward end of the hook-shaped gripper 64, and can also be threadingly secured onto the threaded portion 10 of the enlongated cylindrical body 9 to be used when applicable.

To operate the apparatus, the present invention 1, for example, is placed against a concave structure of a metal work piece 46 as shown in FIG. 4. One hand is placed on the impact member 14 and the other hand on the hand held air drill 36. After contacting the desired area of the work piece 46, the apparatus is then pushed in the direction of the arrow 50 or to the left against the work piece 46 until the engagement procedure of the present invention 1 is completed. As shown in FIG. 3, the stop member 29 and the stop member 30 will immediately spread apart from one another. This will prevent frictional contact between the two mentioned stop members while the stop member 30 is turning clockwise or in the direction of the arrow 48. Continuing on, the hand held air drill 36 is switched on in the direction of the arrow 48 by using the provided switch 45. When the trigger switch 51 is activated, the enlongated cylindrical body 9 and the attached self-drilling sheet metal screw 2 will rotate in the mentioned direction of the arrow 48 (clockwise).

In FIG. 4, the drill bit tip 3 of the mentioned self-drilling sheet metal screw 2 will then penetrate the metal work piece 46, and the enlongated threaded body of the self-drilling sheet metal screw 2 will then follow and engage onto the work piece 46. The present invention 1 is now engaged onto the metal work piece 46. The impact member 14 is manually operated and is slidably mounted on the exterior of the enlongated cylindrical body 9 and is of sufficient weight to create an impact, and is then manually slammed in the direction of the arrow 49 or to the right onto the secured stop member 16.

Let it be noted: The stop member 30 (as shown in FIG. 2) will also clash against the inner enclosed stop member 29 of the stop and closure member 27 by the same mentioned impact so as to prevent the enlongated cylindrical body 9 from separating apart from the 3rd closure member 37 on the hand held air drill 36 when an impact is created. This should be the only time of contact between the two mentioned stop members. The force of this impact will have the tendency to pull the present invention 1 and the concave structure towards the same direction as the impact or the direction of the arrow 49, for example, and the operation can be repeated until the damaged area has been returned to its original contour.

The strike washer 12 (as shown in FIG. 4) is used to receive a similar impact as the stop member 16 from the impact member 14. The only difference is the direction in which the impact member 14 is slammed into. This operation is only applied when the work piece 46 has been overpulled in the direction of the arrow 49 or to the right exceeding the original contour. It will then be merely necessary to slide the impact member 14 in the direction of the arrow 50 or onto the strike washer 12 to restore the overpulled work piece 46 to its original contour.

When you have reached the correct contour, and you wish to remove the present invention 1, you then once again push. lightly in the direction of the arrow 50 atavist the work piece 46 until the disengagement procedure of the present invention 1 is completed. This procedure is useful to help separate the stop member 29 and the stop member 30 (as shown in FIG. 3) to prevent frictional contact between them when the stop member 30 is rotating in the direction of the arrow 47 (counterclockwise). Continuing on, set the switch 45 to rotate the enlongated cylindrical body 9 and the attached self-drilling sheet metal screw 2 counterclockwise or in the direction of the arrow 47. The trigger switch 51 is then activated and the present invention 1 will then disengage itself from the work piece 46 as shown in FIG. 4. The hole left by the self-drilling sheet metal screw 2 can then be filled with repair material to refinish the surface area.

The suction cup 57 shown in FIG. 5 is adapted to the forward end of the enlongated bar 9 and could be applied to a panel in order to avoid having to make holes in a metal work piece. The hook-shaped gripper 61 shown in FIG. 6 is adapted to the forward end of the enlongated bar 9 and could be applied to the edges of a panel or where applicable in order to restore the work piece to its original contour. These embodiments and any other embodiments can only be used manually with the chosen power source deactivated.

The preceding description and drawings of the present invention are provided for the purposes of explanation and illustration. The attachment in operation as shown in FIG. 4 is attached to a power source such as an air-powered hand held air drill. It should be noted here that while the present invention has generally been described with relation to repairing the body of automobiles, that the present invention can also be used on any other type of sheet metals such as that of airplanes, boats, doors, refrigerators, beams, and the like.

The present invention could be mounted on any other power source other than a hand held air drill providing the chosen power source is equipped with a forward (clockwise) and reverse (counterclockwise) rotary feature. The chosen power source can be powered by air, electric, batteries, or cordless sources. Also no specific metal or material, size, or weight has been mentioned since it would be a matter of preference. Permanently secured means not detachable, in other words to be molded, welded, bonded or any other means of connecting two objects together.

It will be apparent to those skilled in the relevant art that modifications and changes may be made to the invention as described without departing from its scope and spirit.

What I claim is:

1. A dent removing tool having means for attaching onto a rotary power source comprising:

a slide hammer having an elongated body with impacting means mounted for reciprocal movement thereon, screw means mounted on one end of said elongated body for enabling said slide hammer to engage, penetrate and disengage from an intended workpiece, an impact-receiving member mounted on the opposite end of said elongated member, mounting means on said elongated body for attaching said slide hammer to a rotary power source, said mounting means including bearing means to allow relative longitudinal movement of said elongated body therethrough, and further including an impact-transmitting member to transmit impacts from said impacting means to said impact-receiving member and said elongated member, a driving connection between said elongated body and said rotary power source for imparting rotary force to said elongated body as well as allowing longitudinal movement between said elongated body and said rotary power source, whereby said impact-transmitting member and said impact-receiving member may be separated from one another when rotary force is imparted to said elongated member may be placed in contact with one another when an impact is imparted to said impact-transmitting member.

2. A dent removing tool according to claim 1 in which said screw is a self-drilling screw.

* * * * *